United States Patent [19]

Hyde et al.

[11] Patent Number: 4,722,521

[45] Date of Patent: Feb. 2, 1988

[54] MECHANISM FOR MAINTAINING A SWINGING MOVEMENT

[75] Inventors: Richard E. Hyde, Rancho Dominguez; Dale D. Kelly, Marina Del Rey, both of Calif.

[73] Assignee: California Strolee, Inc., Rancho Dominguez, Calif.

[21] Appl. No.: 776,903

[22] Filed: Sep. 17, 1985

[51] Int. Cl.[4] ..... A63G 9/16

[52] U.S. Cl. ..... 272/86; 248/370; 5/108

[58] Field of Search ..... 272/86; 297/260, 273; 248/370; 5/108, 109

[56] References Cited

U.S. PATENT DOCUMENTS

| | | | |
|---|---|---|---|
| 2,024,855 | 12/1935 | Goetter | 272/86 |
| 2,520,563 | 8/1950 | Preston | 297/260 X |
| 3,261,032 | 7/1966 | Reardon | 5/109 X |
| 3,361,405 | 1/1968 | Gottlieb | 248/370 |
| 3,842,450 | 10/1974 | Reza Pad | 5/109 |
| 4,150,820 | 4/1979 | Bochmann | 272/86 |
| 4,211,401 | 7/1980 | Cunard | 272/86 |
| 4,491,317 | 1/1985 | Bansal | 272/86 |

FOREIGN PATENT DOCUMENTS 631026 10/1949 United Kingdom .

*Primary Examiner*—Richard J. Johnson
*Attorney, Agent, or Firm*—Lyon & Lyon

[57] ABSTRACT

A swinging mechanism for maintaining pendular movement in a swing. A revolving plate is provided which engages a propulsion member on the swing so as to apply torque to the swing during part of the swing cycle, maintaining pendular movement of the swing despite energy loses due to air friction and the like. Switches are provided to activate rotation of the revolving plate when the swing has reached a rear position, and to continue movement of the revolving plate to return it to a neutral or original position in preparation for the next cycle of the swing movement.

12 Claims, 9 Drawing Figures

MECHANISM FOR MAINTAINING A SWINGING MOVEMENT

BACKGROUND OF THE INVENTION

The field of the present invention is mechanisms for maintaining swinging or pendular movement.

Mechanisms for maintaining swinging movement in a pendulum are old in the art of clocks, Foucault pendulums and the like. In addition to time pieces, mechanisms for maintaining a swinging or pendular motion are useful in swinging seats or bassinets for infants, small children and the like. Such mechanisms maintain swinging action automatically without the intervention of an adult. The swinging action of the child's seat helps pacify the child and keep it in a contented state.

Mechanisms for maintaining pendular movement, hereinafter referred to as swinging mechanisms, which may be adapted for use in children's swinging chairs must meet special requirements. Most importantly, they must be capable of swinging the chair despite wide variations in the weight and height of the child, which affects the period of the pendulum formed by the seat or bassinet and child. Swinging mechanisms should also be safe when used with children and easy to operate. If battery-powered, they should use little power to avoid running down the batteries too quickly.

SUMMARY OF THE INVENTION

The present invention is directed to a swinging mechanism. A revolving plate is provided that engages a member attached to the pendulum or other device desired to be swung; motor and gear means are provided for revolving the plate; and switching means are provided for activating the motor means when the swing is in a first position, thus causing the revolving plate to act upon the member attached to the pendulum to push it in the direction of a second position and thus maintaining pendular motion. The switching means is activated only when the pendulum is in the first position and continues to be activated until the revolving plate returns to a static or ready position, awaiting the return of the pendulum from the second to the first position. Thus, the swinging mechanism is independent of the period of the pendulum which will vary with the character of the pendulum. In the case of a swinging chair or bassinet for infants or small children, children of varying weights and heights may be accommodated by this swinging mechanism. In one embodiment of the invention, the swinging mechanism does not operate when the pendulum or swinging chair is in a static or rest position between the first and second positions and is not in motion. Thus, if the swinging chair or bassinet should come to rest for whatever reason, the power supply for the motor means is not wasted in attempting to initiate pendular motion. A self-starting feature may be incorporated, which would act to initiate pendular movement when the pendulum is in the static or rest position.

Accordingly, an object of the present invention is to provide swinging mechanisms capable of maintaining swinging or pendular motion despite variation in the natural period of the swing or pendulum.

Another object of the present invention is to provide swinging mechanisms that are simple, easy to make, lightweight, and economical in the use of energy.

A further object of the present invention is to provide swinging mechanisms that may be used with lightweight sources of stored energy such as batteries.

A still further object of the present invention is to provide a swinging mechanism capable of use in swinging chairs or bassinets for small children or infants which is safe and easy to operate. Other and further objects and advantages will appear hereinafter.

DETAILED DESCRIPTION OF THE PREFERRED EMBODIMENT

Figure 1:
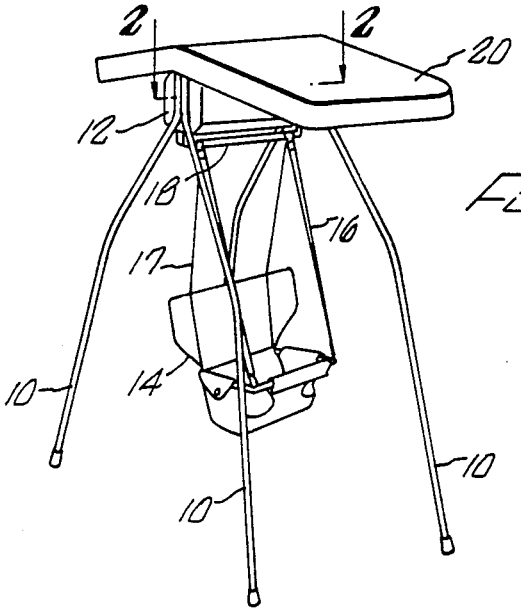
FIG. 1 is an elevated perspective view of a swinging chair for infants or small children incorporating an embodiment of the present invention.

Turning in detail to the drawings, FIG. 1 illustrates a swinging chair for infants or small children. The swinging chair is supported by four support legs 10 which are attached to support box 12 which in effect acts as a support beam between each pair of support legs 10. A seat 14 is suspended from a U-shape swing bar 18 by means of straps 16 and seat support rods 17. A bassinet may be provided, instead of a seat, if very small infants are to be accommodated. U-shaped swinging bar 18 is in turn suspended from support box 12. An awning 20 is supported by support box 12 and shields the infant from sunlight.

Figure 2:
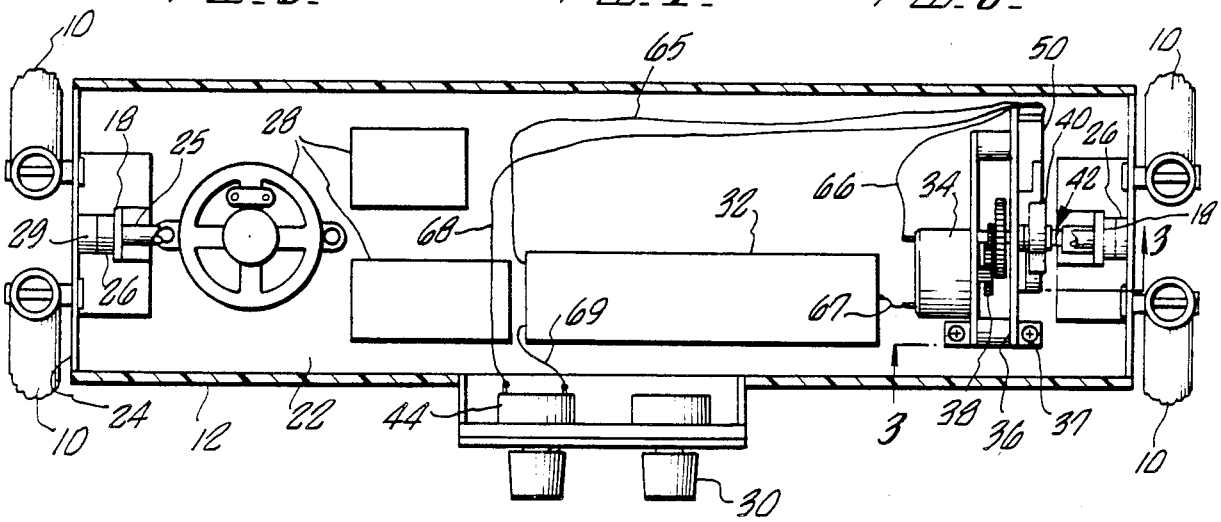
FIG. 2 is a top plan view of the support box of the swinging chair depicted in FIG. 1, which includes a top plan view of the mechanism of an embodiment of the present invention.

FIG. 2 shows a top plan view taken along a cross section of the support box 12. Base 22 of the support box 12 from which rise side walls 23 and end walls 24. End walls 24 mounts swing bar pivots 26 from which depend the U-shaped swing bar 18. U-shaped swing bar 18 enters the face 22 of support box 12 via swing bar openings 27. Music system components 28 are shown in schematic outline and are controlled by music systems switch 30. (The music system plays soothing music to keep the infant or small child content.)

The mechanisms and components of a swinging chair described above are not necessarily novel and are shown merely to depict the application of the invention in its preferred embodiment form. Turning now to the mechanism of the invention, in FIG. 2 may be noted battery box 32 which contains batteries (not shown). The batteries serve as the power supply for operation of the swinging mechanism of the preferred embodiment of the present invention. The batteries 33 provide power for operation of a small direct current motor 34. Although the preferred embodiment of the present invention uses a battery-driven direct-current motor, other power sources and motors could be used in accordance with the present invention. For example, the power supply could be 120 volt AC wall current supplied to the swinging mechanism via an extension cord and the motor could be a standard AC motor. The provision of such alternate power and motor means is well-known to the art, and the invention is deemed to include such variations.

Motor 34 is mounted on a gear box 36 which is in turn supported by base 22. Gear box 36 and base 22 are connected by gear box attachments screws 37. A gear box 36 contains gearing 38 which serves as a reduction gear mechanism to convert the high rotational speed of motor 34 into slower rotational speed of revolving plate 40 which is supported by and driven by gearing 38. Revolving plate 40 engages swing bar propulsion member 42 in a manner to be described more fully hereinafter.

Swing propulsion switch 44 is provided to permit starting and stopping the operation of the swing mechanism of the present invention. First, second, third, fourth, and fifth conducting lines 65 through 69 connect battery box 32, direct current motor 34, swing propulsion switch 44, and the switching means of the present invention in an electrical circuit to be described later.

Figure 3:
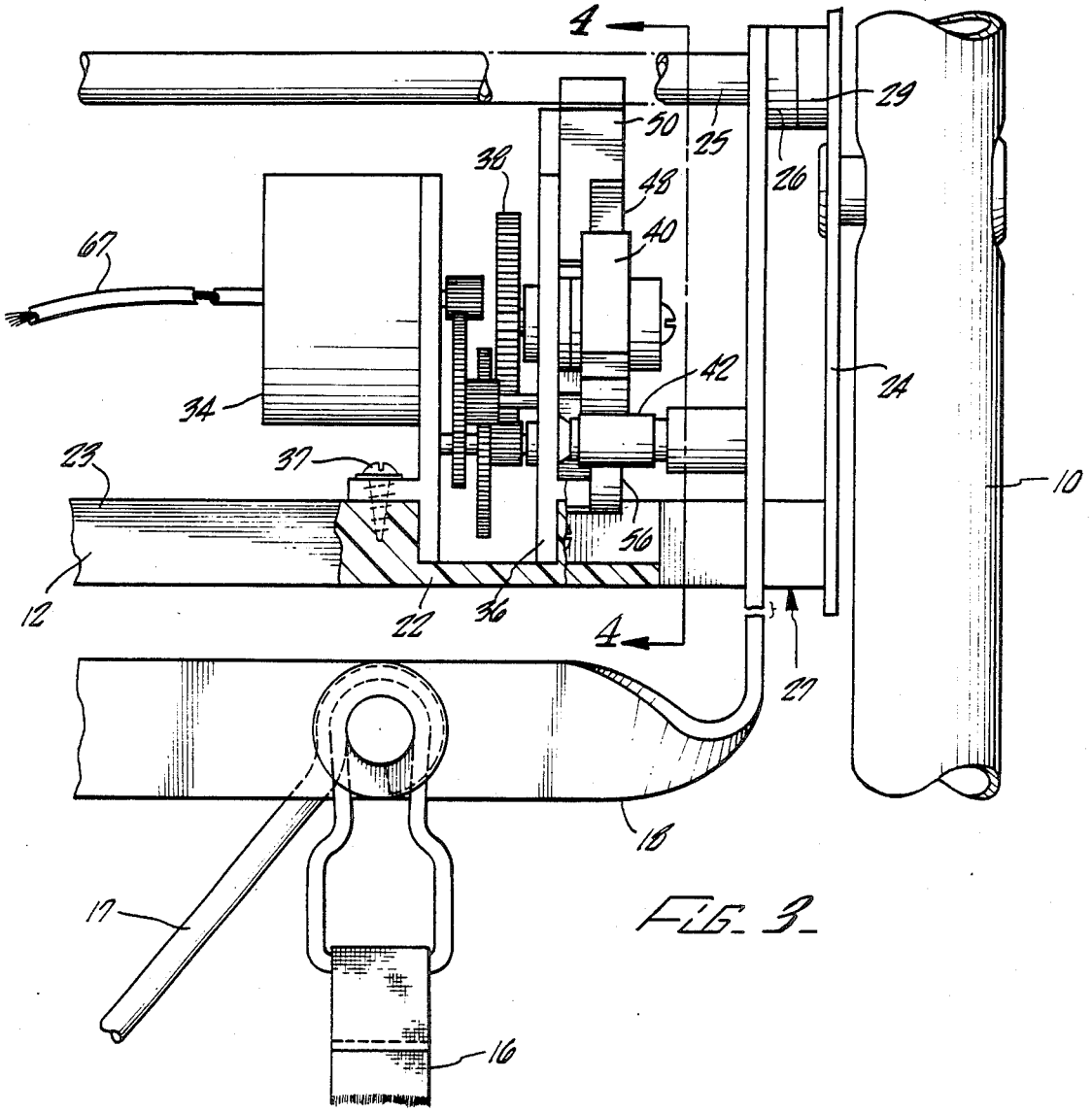
FIG. 3 is a side plan view taken on line 3—3 of FIG. 2 of a portion of the mechanism of the present invention with segments of the support box cut away to better show that mechanism.

FIG. 3 depicts a side plan view of part of the mechanism of the present invention with parts of base 22 and side walls 23 cut away to better show the mechanism. Again, direct current motor 34 is shown mounted on gear box 36 which in turn is secured to face 22 via screws 37. Gear box 36 has two walls between which are mounted reduction gearing 38. Revolving plate 40 emerges from the right side of gear box 36 in FIG. 3. Beneath is shown swing bar propulsion member 42 attached to U-shape swing bar 18. U-shaped swing bar 18 penetrates base 22 via openings 27 and is suspended from rod 25. Rod 25 extends from one side to the other of support box 12 and is parallel to base 22. Washer 29 is fastened to end wall 24 and supports rod 25. Bushing 26 acts as a spacer between U-shaped swing bar 18 and wall 24. The U-shape swing bar 18 is therefore free to swing back and forth in a plane perpendicular to that of FIG. 3. Swing bar propulsion member 42 accordingly will move with U-shaped swing bar 18 and describe an arc under revolving plate 40 when the swing bar is in motion. FIG. 3 shows the swing mechanism and swing in a static or neutral resting position, when the swing hangs down from support box or beam so that its center of gravity is stationarily positioned along a plane intersecting rod 25 and the center of mass of the earth.

Figure 4:
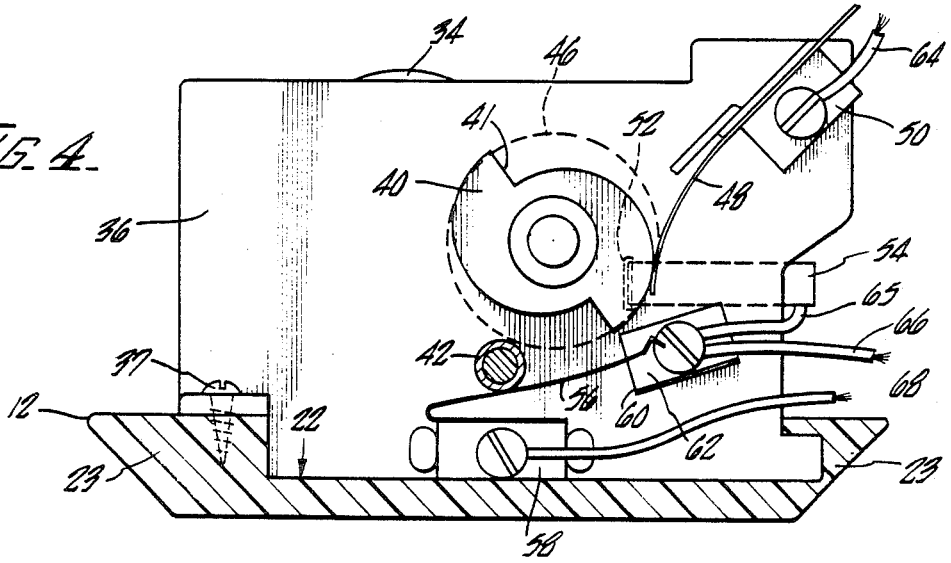
FIG. 4 is an end cross-sectional view taken on line 4—4 in FIG. 3 showing part of the mechanism of an embodiment of the present invention.

FIG. 4 depicts an end cross-sectional view of part of the mechanism of the present invention. One of the walls of gear box 36 blocks view of gearing 38 and most of motor 34. In this figure the shape of revolving plate 40 is shown to be in the form of a toothed wheel having propulsion surfaces 41. The particular shape of the preferred embodiment of the revolving plate is that of two cam surfaces displaced along a diameter to create a toothed wheel effect. In the preferred embodiment depicted, the cam surfaces have the general appearance of semicircles when seen from a point displaced along the axis of and at a distance from the revolving plate. As seen in FIG. 4, revolving plate 40 will rotate clockwise describing an imaginary circle 46. Swing bar propulsion member 42 is free to move back and forth in a short arc beneath revolving plate 40; in FIG. 4, however, it is shown in the position it has when the swing bar 18 is in a resting or neutral position.

Also to be seen in FIG. 4 are the essential components of the switching means of the present invention. This switching means includes two switches, each formed of a pair of contacts one of which is stationary and the other of which is a flexible metallic leaf spring. Thus, first contact 48 is a flexible metallic strip attached to first contact support flange 50 which in turn is connected to gear box 36. First contact 48 may engage second contact 52 which protrudes in the space between propulsion disc 40 and gear box 36 but does not engage or slow down propulsion disc 40. Second contact 52; is attached to second contact support flange 54 which is on the other side of the gear box wall. Second contact 52 therefore protrudes through a slot in the gear box wall so that it may engage first contact 48. Underneath propulsion disc 40 is located third contact 56 which is a flexible metallic strip which is disposed to approach propulsion disc 40. Third contact 56 is attached to third contact support flange 58 which in turn is secured to gear box 36. Third contact 56 may be depressed so that it engages fourth contact 60 which is supported by fourth contact support flange 62 which in turn is mounted on gear box 36. All of the contacts and their support flanges are metallic for conduction of electricity; the gear box wall 36 should be non-conductive.

FIG. 4 shows the swing in a static or resting position; that is hanging from support box 12. In this position swing bar propulsion member 42 does not cause third contact 56 to engage fourth contact 60. In addition propulsion disc 40 is shown in its neutral or static position in which it has deflected first contact 48 away from second contact 52. Thus, none of the contacts touch each other preventing all passage of electrical current in the electrical circuit of the swinging mechanism. Method of operation of the swinging mechanism and in particular that of the switching means formed by the four contacts and their cooperation with propulsion member 42 and revolving plate 40 are better shown in the subsequent figures.

Figure 5:
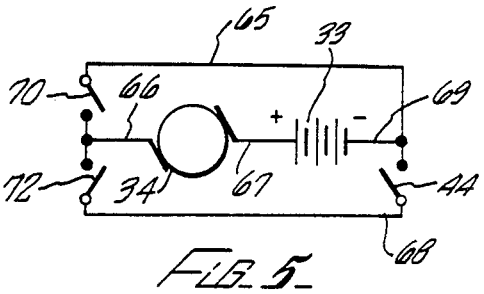
FIG. 5 is a circuit diagram depicting the electrical system of an embodiment of the present invention.

FIG. 5 shows a schematic circuit diagram of the electrical system of the preferred embodiment of the present invention. This circuit comprises three switches, a direct current motor, batteries (represented by one battery symbol 33) and connecting conducting lines. Switch 44 is a simple on-off switch mounted on support box 12. Switches 70 and 72 are formed of the combination of contacts 48, 52, and 56, 60 respectively. One may note that switches 44 and 72 are in the same branch whereas switch 44 does not control the branch incorporating switch 70. Motor 34 will always be activated when the contacts forming switch 70 touch as long as batteries are present in the battery box 32. As will be seen this is necessary to return the propulsion disc 40 to its neutral position regardless of whether the operator has turned switch 44 on or off. When in the neutral position, revolving plate 40 is positioned so that it will not interfere with this swinging of the swing bar.

The essential purpose of the circuit depicted in FIG. 5 is to activate motor 34 whenever either switches 70 or 72 are closed, so long as switch 44 is also closed. Motor 34 will be stationary and unpowered only when both switches 70 and 72 are unclosed.

Turning now to FIGS. 6 through 9, one may observe the method of operation of the invention. FIGS. 6 through 9 are simplified views of the revolving plate 40, swing bar propulsion member 42, and the switching means of the present invention, much as shown earlier in FIG. 4. FIG. 4 depicts the situation when the swing bar is hanging statically from the support box 12 and revolving plate 40 is in its neutral position. In the state depicted in FIG. 4, neither of switches 70 or 72 in the form of contacts 48, 52, 56, and 60 are closed. As noted earlier in the discussion of FIG. 5, motor 34 cannot be activated then.

The preferred embodiment of the invention does not possess a self-starting feature and the operator will have to physically initiate movement of the swing to commence the swinging motion, in the manner to be described below. Other embodiments of the present invention, fully consistent with the inventive concept herein disclosed, could employ a self-starting feature in addition to the basic mechanism described earlier. For example, a parallel switch-containing circuit could be provided that would bypass switch 70 (FIG. 5). When this bypass circuit's switch was closed, it would activate motor 34 and commence movement of revolving plate 40 in order to commence the swinging movement.

Figure 6:
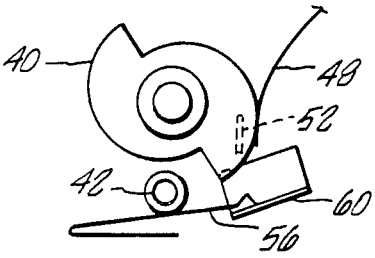
Figure 7:
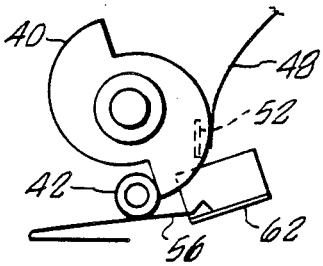

To activate the swinging mechanism, the operator must both turn switch 44 on and also give the swing a push to start pendular movement. As the swing moves to the rear to a first position, "rear" being with reference to a forward direction that is the direction faced by a child seating in the swing seat, swing bar propulsion member 42 moves likewise rearwardly to a first position more directly underneath and to the right of the revolving plate 40 as seen in FIGS. 6 and 7. In FIG. 6 the propulsion member 42 is approaching the first position and in doing so deflects third contact 56 downwardly so that third contact 56 engages fourth contact 60 completing an electrical circuit which, if switch 44 is closed, will cause direct current to pass through the wiring of direct current motor 34 which then acts through gearing 38 to rotate revolving plate 40 in a clockwise direction as seen in FIGS. 6 and 7. When propulsion member 42 reaches the first position as shown in FIG. 7 it engages to the surface 41 of revolving plate 40 which has moved down and to the left as seen in FIGS. 6 and 7. At this point, rearward movement of the swing has terminated and the swing is momentarily stationary in FIG. 7 but the rotation of revolving plate 40 pressing on propulsion member 42 by way of propulsion surface 41 will presently cause propulsion member 42 to move forwardly, thereby applying torque to the swing in order to rotate it forward to a second position. This will maintain the pendular movement despite energy loses due to air friction and the like.

The revolving plate must rotate more swiftly than the natural period of the pendulum in order for the mechanism of the preferred embodiment to work consistently and smoothly as described above. In other words, the revolving plate 40 must rotate 180° between the positions shown in FIGS. 6 and 9 in a shorter time than the propulsion member 42, governed by the natural period of the pendulum, can return to its position as shown in FIG. 6. Rotational speed of revolving plate 40 is governed by the choice of motor 34 and reduction gearing 38. Experience has proven that a rotational speed 20% faster than the natural pendulum period is satisfactory.

Figure 9:
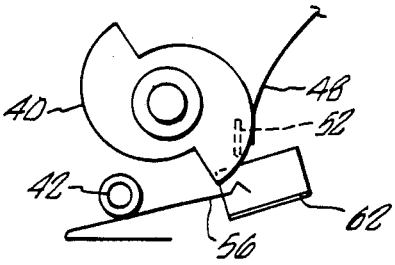
FIGS. 6 through 9 depict the revolving plate and a portion of the switching means of the invention acting in conjunction with the swing bar propulsion member, in a demonstration of the cycle of operation of an embodiment of the present invention.
Figure 8:
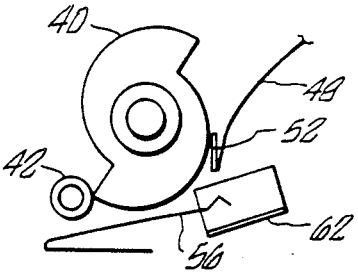

As revolving plate 40 continues to rotate, propelling propulsion member 42 forward, its diameter in the vicinity of second contact 52 diminishes and first contact 48 is permitted to straighten and touch second contact 52. When contacts 48 and 52 are touching then switch 70 is closed and electric current will be supplied to motor 34. As seen in FIG. 8, contacts 48 and 52 are touching and switch 70 is closed even though propulsion member 42 has moved far enough to the left or forwardly so as to clear third contact 56 which is then permitted to spring away from fourth contact 62. Thus, revolving plate 40 continues to rotate until such time as one of its propulsion surfaces or increased diameter sections engages first contact 48 causing that contact to be depressed down and to the right and thus away from second contact 52. At that point, switch 70 is no longer closed and electric current cannot flow to motor 34. As depicted in FIG. 9 revolving plate 40 has caused switch 70 to be opened, and the revolving plate 40 has reached its neutral position, from which it cannot move until propulsion member 42 returns on the back swing to cause contacts 56 and 62 to touch once more thereby setting in motion a new cycle.

Thus, the cooperation of switches 70 and 72 in the form of contacts 48, 52, 56 and 62 forms a switching means which activates revolving plate 40 to press on propulsion member 42 connected to the swing or pendulum only when that propulsion member 42 or swing or pendulum reaches one side or end of its swing. Because the switching means is activated directly by the swing itself, the swing mechanism will maintain the pendular movement of the swing in accordance with its natural period. Notably, the swinging mechanism is not directed by any independent or outside timing mechanism.

In theory the period of a pendulum is unaffected by its mass. The period is calculated according to the equation $$T = \frac{2\pi}{(gh/a^2)^{\frac{1}{2}}}$$

in which T=period, g=local acceleration of gravity, h is the distance of the center of mass from the axis of rotation, and a= mean perpendicular distance of mass from axis of rotation. (The angular divergence of the pendulum from vertical, $\theta$, is assumed to be sufficiently small that $\sin\theta \approx \theta$.) The effect of air friction will cause the period of the pendular motion to be affected by the mass of the swing; the pendular motion will also be damped, requiring the use of a mechanism such as the present invention to maintain pendular movement by supplying energy to the pendular system to overcome frictional losses. The mechanism of the present invention therefore accommodates different weights in the swing or pendulum (and thus accommodates children of different ages and sizes) because it always operates in accordance with the period of the actual swing. In addition to differing weights of infants the varying sizes of the children and their orientation within the swing (whether in seat or bassinet), affect the moment of inertia ($ma^2$ where m=mass of the pendulum) and the distance of center of mass from the axis of rotation of the swing or pendulum, which in turn directly affects the period of pendular motion even in the absence of air friction. As before, the mechanism of the present invention will accommodate different periods resulting from these different weight distributions within the swing.

Thus, a swinging mechanism is disclosed which can accommodate itself to different periods of motion of the swing and in addition is simple in operation and inexpensive to construct. It is also safe to operate and appropriate for use in children's swings. While embodiments and applications of this invention have been shown and described, those skilled in the art will perceive that many more modifications are possible without departing from the inventive concept herein. The invention, therefore, is not to be restricted except in the spirit of the appended claims.

What is claimed is:

1. A mechanism for maintaining swinging movement of a swing bar for operating devices such as swinging chairs for small children, swinging bassinets for infants, and the like, comprising:

a support box;

a toothed plate having an axis about which it is capable of revolving, the toothed plate being rotatably attached to the support box and adjacent to the swing bar so as to be capable of engaging the swing bar, the toothed plate having a plurality of propulsion surfaces for engaging the swing bar in order to propel the swing bar from a first toward a second position, the toothed plate having a neutral position in which the toothed plate does not interfere with movement of the swing bar between the first and second positions;

means for rotating the toothed plate in a single direction;

means for activating the rotation means responsive to the position of the swing bar, the rotation means being activated when the swing bar is in the first position so as to cause the toothed plate to rotate, so that any one of the propulsion surfaces of the toothed plate engage the swing bar and press the swing bar from the first position towards the second position, the activation means also being responsive to the rotational position of the toothed plate in order to de-activate the rotation means when the toothed plate has returned to the neutral position.

2. The mechanism for maintaining swinging movement of claim 1 in which said means for rotating the toothed plate comprises an electric motor and a power supply in circuit together, said means for activating the rotation means comprises a first electric switch closed by the swing bar when said swing bar approaches the first position, and a second electrical switch closed by action of the toothed plate when said toothed plate is not in its neutral position, said first and second electric switches being connected in parallel circuit between the motor and the power supply.

3. The mechanism for maintaining swinging movement of claim 2 in which the next sequential propulsion surface of the toothed plate opens said second electrical switch when the toothed plate approaches the neutral position.

4. The mechanism for maintaining swinging movement of claim 3 in which said toothed plate has two propulsion surfaces and a smoothly curving perimeter of increasing diameter between each propulsion surface.

5. The mechanism for maintaining swinging movement of claim 4 in which the swing bar has a substantially horizontal propulsion member attached thereto adjacent to the toothed plate and which closes the first electric switch when the swing bar approaches and reaches the first position, said propulsion member being engaged by one of the propulsion surfaces of the toothed plate upon rotation of the toothed plate and the axis of the toothed plate being substantially horizontal.

6. The mechanism for maintaining swinging movement of claim 5 in which said first and second electric switches are comprised of flexible metal contacts which are deflected, respectively, by movement of the propulsion member when the swing bar approaches the first position and movement of the toothed plate when he toothed plate approaches the neutral position.

7. The mechanism for maintaining swinging movement of claim 6 in which the toothed plate has the outline shape of two cam surfaces displaced along a diameter.

8. The mechanism for maintaining swinging movement of claim 6 in which the motor is a direct current electric motor.

9. The mechanism for maintaining swinging movement of claim 6 further comprising reduction gearing between the electric motor and the toothed plate, said reduction gearing causing the toothed plate to rotate at a slower rotational speed than the electric motor.

10. The mechanism for maintaining swinging movement of claim 9 in which the reduction gearing causes the toothed plate to rotate at a rotational speed greater than that of the period of the swing bar and its attached swinging chair, swinging bassinet or the like, in that the toothed plate rotates 180° in a time smaller than the period.

11. The mechanism for maintaining swinging movement of claim 6 further comprising a third electric switch in series with the first electric switch for preventing operation of the mechanism for maintaining swinging movement when the third electric switch is open.

12. A mechanism for maintaining swinging movment of a swing bar for operating devices such as swinging chairs for small children, swinging bassinets for infants, and the like, comprising:

a support box;

a toothed plate having an axis about which it is capable of revolving, the toothed plate being rotatably attached to the support box adjacent to the swing bar so as to be capable of engaging the swing bar, said toothed plate having an outline composed of two cam surfaces displaced along a diameter forming two propulsion surfaces with curving surfaces therebetween, said toothed plate having a neutral position in which said propulsion surfaces do not interfere with movement of the swing bar from a first to a second position;

an electric motor in circuit with a power supply;

gearing means between the electric motor and the toothed plate for rotation of the toothed plate in a single direction, said gearing means reducing the rotational speed of the electric motor so that the toothed plate rotates at a slower rotational speed than that of the motor, but fast enough to rotate 180° in a shorter time than the period of the swing bar and its attached swinging chair, swinging bassinet or the like;

a propulsion member attached substantially horizontally to the swing bar adjacent to the toothed plate, the axis of the toothed plate being substantially horizontal, the propulsion member being capable of moving with the swing bar and underneath the axis of the toothed plate;

a first electric switch comprising a flexible first metallic contact and a stationary second metallic contact, said switch being in circuit between the electric motor and the power supply, said first electric switch being closed by the propulsion member pressing on the flexible first contact when the swing bar moves toward the first position and thus causing the first contact to touch the second contact but not otherwise, the first electric switch when closed activating the electric motor and causing the toothed plate to rotate;

a second electric switch comprising a flexible third metallic contact and a stationary fourth metallic contact, the flexible third metal contact being deflected by the propulsion surfaces of the toothed plate to such a degree that when the toothed plate is in its neutral position the third and fourth contacts are separated and the second electric switch is opened but not otherwise, the second electric switch when closed causing activation of the electric motor in order to cause the toothed plate to rotate to return to the neutral position upon which the second electrical switch will be open, the motor will be deactivated, and rotation of the toothed plate will cease until the first switch is closed by movement of the swing bar to the first position; and a third electric switch in series circuit between the motor and the first electric switch, the third electric switch preventing operation of the motor when opened.

* * * * *